United States Patent [19]

Williams et al.

[11] Patent Number: 4,741,058

[45] **Date of Patent: * May 3, 1988**

[54] CONVOLUTED SUPPORT PAD FOR PREVENTION OF DECUBITUS ULCERS AND APPARATUS FOR MAKING SAME

[75] Inventors: H. Albert Williams; Janet L. Williams, both of Canyon Country, Calif.

[73] Assignee: Bio Clinic Corp., Rancho Cucamonga, Calif.

[ * ] Notice: The portion of the term of this patent subsequent to Nov. 4, 2003 has been disclaimed.

[21] Appl. No.: 886,355

[22] Filed: Aug. 29, 1986

Related U.S. Application Data

[63] Continuation of Ser. No. 685,320, Dec. 24, 1984, Pat. No. 4,620,337.

[51] Int. Cl.[4] ..... A47C 27/14

[52] U.S. Cl. ..... 5/468; 5/481

[58] Field of Search ..... 5/481, 464, 448, 431, 5/420, 443, 468; 297/DIG. 1

[56] References Cited

U.S. PATENT DOCUMENTS

| | | | |
|---|---|---|---|
| 3,197,357 | 7/1965 | Schulpen | 5/481 |
| 3,258,791 | 7/1966 | Kaplan | 5/481 |
| 3,604,025 | 9/1971 | Mims | 5/464 |
| 3,681,797 | 8/1972 | Messner | 5/469 |
| 3,828,378 | 8/1974 | Flam | 5/464 |
| 4,042,987 | 8/1977 | Rogers | 5/481 |
| 4,064,578 | 12/1977 | Yamada | 5/481 |
| 4,110,881 | 9/1978 | Thompson | 5/481 |
| 4,399,574 | 8/1983 | Shuman | 5/431 |

FOREIGN PATENT DOCUMENTS

| | | | |
|---|---|---|---|
| 1310373 | 3/1973 | United Kingdom | 5/481 |

*Primary Examiner*—Alexander Grosz

*Attorney, Agent, or Firm*—Beehler, Pavitt, Siegemund, Jagger, Martella & Dawes

[57] ABSTRACT

A convoluted foam pad adapted to be positioned on a bed in a supporting relationship to a patient is provided. The pad has a head and a foot supporting section, each in the form of a convoluted, checker board pattern of rows of peaks separated by depressions. A torso supporting section, located between the head and foot supporting sections, comprises substantially parallel ribs separated by substantially parallel valleys.

1 Claim, 2 Drawing Sheets

CONVOLUTED SUPPORT PAD FOR PREVENTION OF DECUBITUS ULCERS AND APPARATUS FOR MAKING SAME

This is a continuation of application Ser. No. 685,320, filed 12-24-84, now U.S. Pat. No. 4,620,337.

BACKGROUND OF THE INVENTION

The present invention relates to convoluted support pads adapted for supporting at least a part of the body and also for preventing the formation of decubitus ulcers thereon. More specifically, the present invention relates to a convoluted foam body supporting pad designed as a hospital bed pad, for example, for supporting bed ridden patients who are particularly susceptible to the formation of decubitus ulcers.

DESCRIPTION OF THE PRIOR ART

Convoluted foam body supporting pads, such as bed, chair and other pads, are well known. U.S. Pat. No. 3,693,619 discloses a convoluted foam body support pad adapted to support a patient's heel for example. U.S. Pat. Nos. 3,258,791 and 3,197,357 disclose other convoluted foam pads.

In addition, convoluted foam pads sold under the register trademark EGG CRATE® (a trademark owned by the Bio Clinic Company, Registration No. 1,025,244) have been used by hospitals as bed and chair pads for patients who are either bed ridden or immobile and thus, susceptible to the formation of decubitus ulcers.

Although the EGG CRATE® pads and other similar convoluted foam pads have enjoyed great success in helping to prevent the formation of decubitus ulcers on bed ridden patients, there has been a continuing search in the art for an improved body support pad effective to eliminate the formation fo decubitus ulcers altogether. As a result of this continuing search, there have been developed a number of support pads having two or more fluidly separate sets of inflatable cells which are alternately inflated and deflated. These pads are generally called alternating pressure pads (APP). Various APP's are disclosed, for example, in U.S. Pat. Nos. 3,199,124; 3,394,415; 3,462,778; 3,587,568; 3,674,019 and 3,701,173. While the APP's are helpful in preventing the formation of decubitus ulcers on bed ridden patients, they are not completely effective in doing so. In addition, rather complicated pumps and fluid conveying tubes and valves are required in order to operate a typical APP. Furthermore, such devices typically are expensive and/or difficult to operate outside the hospital setting.

Thus, there has been a need in the art for a body support pad having improved decubitus ulcer prevention properties but which is inexpensive and requires no complex machinery for its operation.

In addition, there has been a need in the art for a body supporting pad adapted for the prevention of decubitus ulcers which provides varying levels of support for different parts of the body. For example, in a hospital bed pad, it is well known that the areas of the body which are most susceptible to the formation of decubitus ulcers comprise the pelvic region and specifically, the hips and buttocks, the elbows, the shoulder regions, the back of the head, and the ankles and heels. Furthermore, each of the above-mentioned decubitus ulcer prone areas have differeing body weights. Unfortunately, the prior art body support pads have generally provided a uniform density, thickness and convoluted configuration throughout the entire pad.

Thus, there has been a further need in the art for a body support pad which provides varying levels of support for the different areas of the body, and specifically for those areas of the body most susceptible to the formation of decubitus ulcers.

SUMMARY OF THE INVENTION

These and other objects are met by a convoluted foam pad for supporting at least part of a body and for preventing the formation of decubitus ulcers thereon as well as an apparatus for manufacturing such a pad. The pad is adapted to support at least one relatively lighter body portion and at least on relatively heavier body portion. The pad comprises one section for supporting a relatively lighter body portion and having a convoluted supporting surface with a first peak-to-base ratio, and a second section for supporting a relatively heavier body portion and having a convoluted supporting surface with a second peak-to-base ratio, the second ratio being lower than the first ratio.

Another embodiment of the invention comprises a convoluted foam body support pad adapted for supporting a relatively heavy portion of a body, such as the hip, buttocks and/or shoulder portions of a human body, comprising a section having a ribbed convoluted supporting surface.

The pad according to the first mentioned embodiment can be manufactured utilizing a pair of rollers each roller comprising a cylindrical roll having a plurality of rings of placed radially extending peaks, the rings being arranged circumferentially around the roll. The peaks of adjacent rings are typically staggered a circumferential distance approximately equal to the width of a peak. Each roller comprises a first section wherein the peaks have a first radial length and a second section wherein the peaks have a second radial length different from the radial length of the peaks in the first section.

The foam pad of the second mentioned embodiment can be manufactured utilizing a pair of rollers each roller comprising a cylindrical roll having a plurality of rings of spaced radially extending peaks, wherein the peaks in adjacent rings are substantially aligned. Usually, the aligned peaks all have a substantially uniform radial length.

Figure 1:
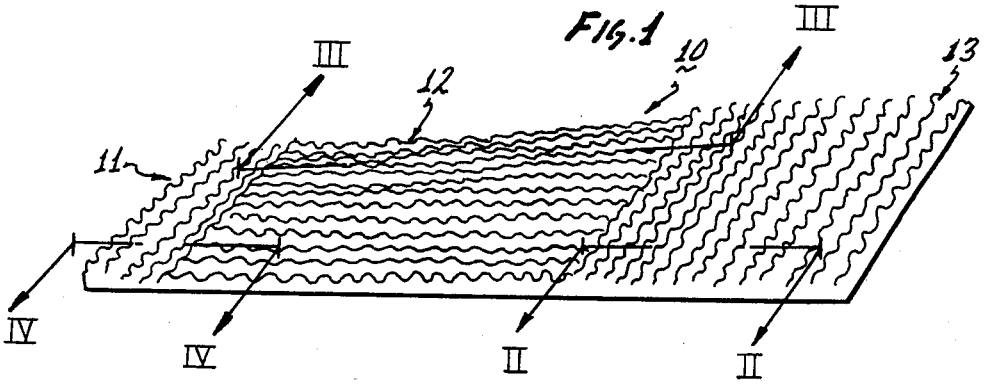
FIG. 1 is a perspective view of one embodiment of a convoluted support pad for prevention of decubitus ulcers according to the present invention.

Although specific embodiments of the invention have been chosen for illustration in the drawings, these are used for illustrative purposes only and should not be used to limit the scope of the invention which is defined in the appended claims.

DESCRIPTION OF THE PREFERRED EMBODIMENTS

One embodiment of the convoluted support pad of the present invention which has been selected for illustration FIGS. 1–4 comprises a body support pad 10 having a length and width sufficient to support a human patient. Typically, pad 10 comprises a polyurethane open cell foam pad adapted to be placed on a hospital bed and having a length of approximately 6 feet, a width of approximately 3 feet, and a thickness which varies along the length of the pad between four and five inches. This thickness variation will be described in greater detail hereinafter.

Pad 10 comprises three distinct sections: a head supporting section 11 having a length of approximately 1 foot; a torso supporting section 12 having a length of approximately 3 feet; and a foot and leg supporting section 13 having a length of approximately 2 feet.

Figure 2:
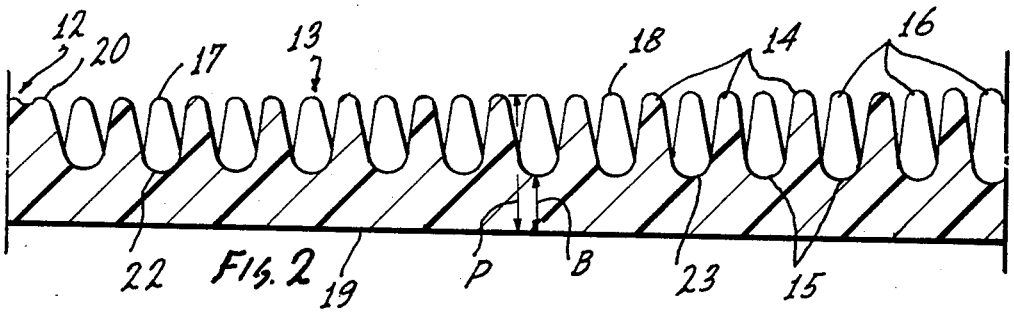
FIG. 2 is a sectional view of the pad shown in FIG. 1 taken along lines II—II.

FIG. 2 is a sectional view of the pad in FIG. 1 taken through sections 12, 13 of pad 10. As seen in FIG. 2, section 13 comprises a plurality of adjacent rows of peaks 14, 16. Peaks 14 are separated by depressions 15. Similarly, peaks 16 in the adjacent row are also separated by depressions which are not shown in the drawing.

The distance from the bottom face 19 of the pad 10 to the bottom of any depression 15 comprises the base height B. Further, the distance from the bottom face 19 to the tip of any peak 14, 16 comprises the peak height P. In pad 10, the sum (P+B) for any adjacent peak and depression is contant, the constant being the (double pad) thickness of the foam slab fed to the convoluter rollers immediately prior to the cutting of two convoluted foam pads 10. It should be pointed out, however, that the sum (P+B) is only equal to a constant when a foam slab having a uniform thickness is fed to the convoluter rollers. This aspect of making the convoluted foam pads of the present invention will be described in more detail hereinafter.

As can further be seen in FIG. 2, both the peak height 18 and the base height B vary along section 13. Thus, peak 17 has a height which is less than the height of peak 18. Similarly, the base height of depression 22 is larger than the base height of depression 23.

As was mentioned earlier, (P+B) equals a constant along pad 10. Thus, the sum of the peak height for peak 17 and the base height of depression 22 is equal to the sum of the peak height of peak 18 and the base height of depression 23.

Figure 4:
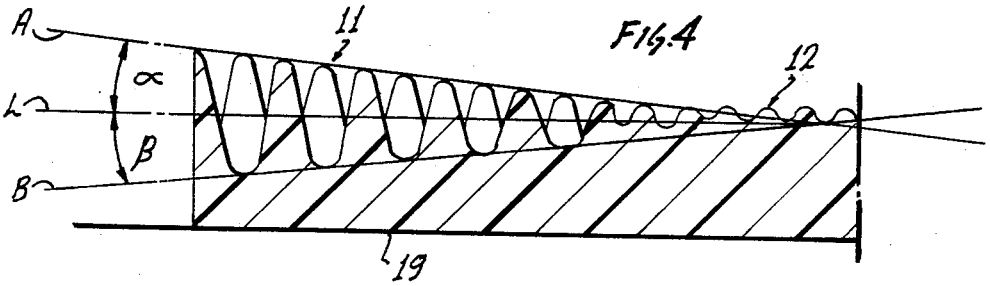
FIG. 4 is a sectional view of the pad shown in FIG. 1 taken along lines IV—IV.

Referring now to FIG. 4, there is shown a sectional view of the pad 10 through the head supporting section 11 and part of the torso supporting section 12. The varying peak and base heights are clearly shown in FIG. 4. An imaginary horizontal plane L is drawn in FIG. 4 as well as a plane A, passing through the tips of the peaks in the section 11 and a plane B passing through the bottoms of the depressions in section 11. Planes A and L intersect to form angle $\alpha$ whereas planes L and B intersect to form an angle $\beta$. In the pad 10, constructed from a foam slab having a uniform thickness, angle $\alpha$ must equal angle $\beta$. This is simply another way of saying that the sum of the peak and base heights for an adjacent peak and depression must be equal to a constant.

It will be easily seen from FIGS. 1–4, that the peak-to-base ratio (P/B) varies along the lengths of sections 11 and 13 of pad 10. In the head supporting section 11 of pad 10, the peak height at the very end of the pad is about 3.75 inches and the base height at the very end of the pad is about 1.375 inches. Therefore, the peak-to-base ratio of section 11 is about 2.7 at the very end of the pad. Toward the torso supporting section 12, the base height increases while the peak height decreases. Thus, in section 11 immediately adjacent the torso supporting section 12, the peak height is about 3.25 inches while the base height is about 1.875 inches. Therefore, the peak-to-base ratio of section 11 immediately adjacent section 12 is about 1.7. Thus, the peak-to-base ratio of section 11 of pad 10 varies between about 2.7 (at the end of the pad) and about 1.7 (immediately adjacent section 12). It will be appreciated that the sum of the peak and base heights at corresponding locations along the pad 10 are equal to 5⅛ inches. This means that pad 10 was cut from a foam slab having a uniform thickness of 5⅛ inches (the slab is cut into two identical convoluted support pads).

Similarly to the head supporting section 11, the foot and leg supporting section 13 has a varying peak-to-base ratio along its length. At the very end of the pad 10, section 13 has a peak-to-base ratio of about 2.7 while immediately adjacent section 12, section 13 has a peak-to-base ratio of about 1.7.

Figure 3:
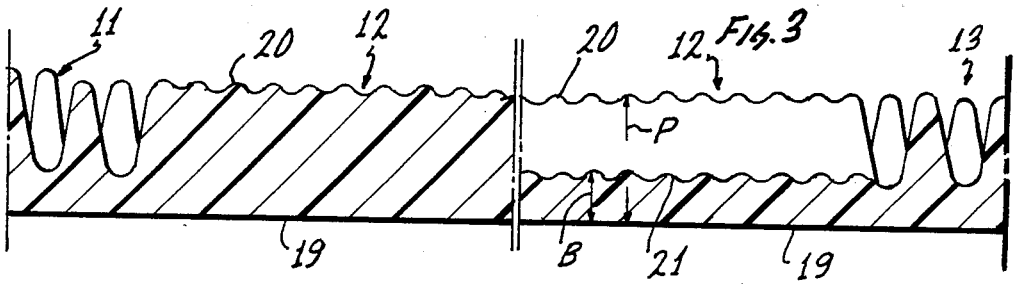
FIG. 3 is a broken sectional view of the pad shown in FIG. 1 taken along lines III—III.

It will also be appreciated from FIG. 3, that the peak-to-base ratio of the torso supporting section 12 is constant along its length. Thus, in the pad 10 selected for illustration in the drawings, the peak height of ridges 20 is about 3.25 inches while the base height of valleys 21 is about 1.875 inches. Thus, the peak-to-base ratio in section 12 of pad 10 is approximately 1.7.

A wide range of peak-to-base ratios may be utilized depending upon the thickness of the pad, the density of the foam as well as the particular application. For example, a pad cut from a one inch thick slab could have a peak-to-base ratio ranging between about 1.67 to about 7.0. On the other hand, a pad cut from a 12 inch thick slab can have peak-to-base ratio ranging from about 1.1 to about 100.

As can be seen from the drawings, there are important differences in the surface configurations of the various sections 11, 12, 13 of pad 10. Sections 11 and 13 both have what is typically referred to as a convoluted surface pattern. This is shown most clearly in FIG. 2 wherein immediately adjacent rows of peaks 14 and 16 are staggered a distance approximately equal to one half the distance between adjacent peaks in any one row. While the advantages of this type of surface pattern are well known to those in the art of preventing the formation of decubitus ulcers, benefits have been surprisingly discovered in varying the peak-to-base ratio in pads having such convoluted surface patterns. It has been discovered that heavier portions of the body are less likely to develop decubitus ulcers when the pad has a lower peak-to-base ratio and conversely that lighter body portions are less likely to develop decubitus ulcers with a convoluted support pad having a higher peak-to-base ratio. With this discovery, a pad may now be provided which is tailored specifically to the various parts of an entire body or to any individual part thereof.

Furthermore, additionally discovered is a new ribbed surface pattern for use in those section of the pad adapted to support heavier body portions such as the torso. The ribbed surface pattern comprises substantially parallel ribs 20 separated by substantially parallel valleys 21. The distance separating immediately adjacent ribs 20 is approximately two inches in the pad 10.

It has further been discovered that the ribbed surface pattern utilized in torso supporting section 12 of pad 10 helps prevent the formation of decubitus ulcers in a number of ways. First, the ribbed surface pattern acts to reduce the pressure exerted on a patient's skin below the level of capillary occlusion, even in the highly critical decubitus ulcer prone areas such as the hips, shoulders, elbows and shoulder areas. Secondly, the rib design promotes air circulation between the pad and the patient which helps to disperse body heat and reduce moisture build up. The increased air flow occurs not only through the valleys 21 but also through the open cells of the foam pad itself. Thirdly, the rib design allows the pad to take advantage of the "floatation concept" even under the relatively heavier body portions such as the torso. The ribbed surface pattern is less likely to "bottom out" under the heavy torso load than the traditional convoluted surface patterns as found in sections 11 and 13. This "bottoming out" phenomenon occurs when the load of the patient is so great that the peaks of the convoluted pad become substantially completely compressed. The ribs 20 are not specifically designed to prop up the patient. Rather, as the body envelopes into the base portion of the pad, the soft foam ribs move with the patient thereby gently stimulating blood flow to the tissue.

Figure 5:
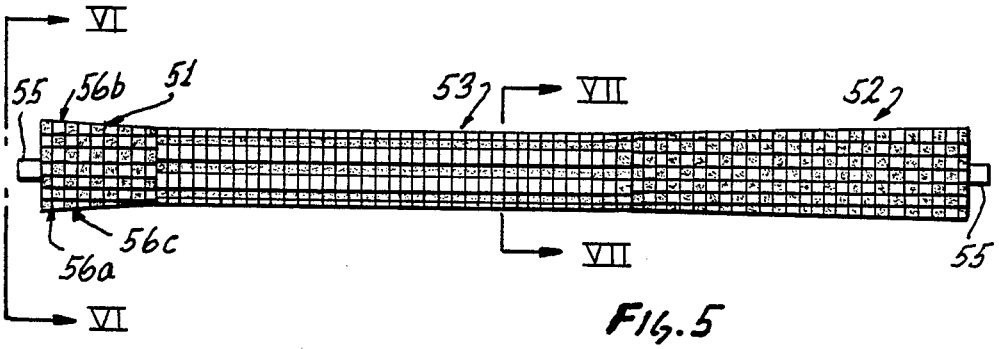
FIG. 5 is a side schematic view of a convoluter roller in accordance with one embodiment of the present invention.
Figure 6:
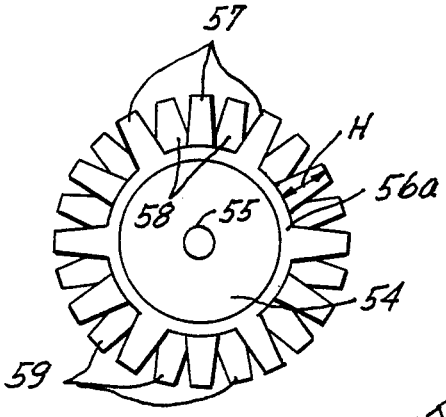
FIG. 6 is an end view of the roller shown in FIG. 5 viewed from the position VI—VI.
Figure 7:
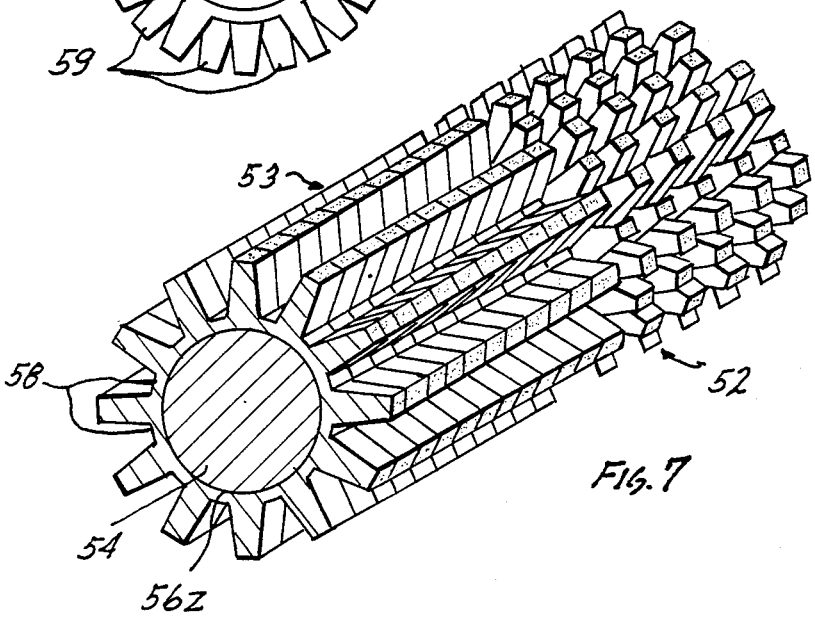
FIG. 7 is a sectional perspective view of the roller shown in FIG. 5 taken along lines VII—VII.

Turning now to FIGS. 5–7, there is illustrated various views of a convoluter roller use to manufacture the pad 10 illustrated in FIGS. 1–4. Referring specifically to FIGS. 5 and 6, the convoluter roller 50 comprises a cylindrical roll 54 mounted on shaft 55. A plurality of rings 56*a*, 56*b*, 56*c*, etc., are fixedly mounted on roll 54. Each ring 56 has a plurality of peaks extending radially from its outer surface. For example, the end ring 56*a* has a plurality of radially extending peaks 57 around its circumference. Similarly, the second ring 56*b* has a plurality of peaks 59 extending radially from its surface. Each peak 57, 59 has a radial height H. In the embodiment of the convoluter roller 50 illustrated in FIGS. 5–7, all of the peaks associated with any one ring 56 have the same radial length H. Thus, each of peaks 57 associated with ring 56*a* have the same radial length. Furthermore, each of the peaks 59 associated with ring 56*b* have the same radial length. However, the radial length of peaks 57 is greater than the radial length of peaks 59. As is shown most clearly in FIG. 5, the convoluter roller 50 has a tapered profile in sections 51 and 52. Referring specifically to section 51, the peaks (represented by the dark squares) in ring 56*a* are longer than the peaks in ring 56*b* which are longer than the peaks in ring 56*c*, etc. so that the roller 50 has a larger diameter at its end (the diameter being measured from the axis of the shaft 55 to the end of a peak). The diameter of the roller decreases along the length of section 51 until immediately adjacent section 53.

Furthermore, the rings in section 54, each ring having the same number of peaks extending therefrom, are staggered a circumferential distance approximately equal to the width of a peak, between adjacent rings. Thus, a "checker board" pattern is formed by the ends of the peaks in section 51.

Section 52 is constructed utilizing a similar design. However, because section 52 is longer than section 51, the degree of taper between the end of the roller 50 and the portion of the roller immediately adjacent section 53 is less.

As is shown clearly in FIG. 6, each of the adjacent peaks 57 are separated by a space 58. Similarly, each of adjacent peaks 59 are separated by a space (not shown). Thus, in FIG. 5, the dark squares represent the ends of the peaks 57, 59, etc. while the unshaded squares represent the spaces 58, etc.

Turning now to the center section 53 of roller 50, it is apparent from FIG. 5 that section 53 has a uniform diameter (i.e. a uniform radial peak length) and further, that all rings are rotated into a position of alignment with the adjacent rings so there are formed rows of adjacent peaks and rows of adjacent spaces.

In the manufacture of a convoluted foam pad, a foam slab is fed to a pair of adjacent parallel convoluter rollers 50. The slab is fed "sideways" into the rollers and is cut into two identical convoluted foam pads 10. Roller section 51 forms pad section 11. Roller section 53 forms pad section 12. Roller section 52 forms pad section 13. Thus, it will be readily appreciated that those portions of roller 50 having peaks with a longer radial length H form pad sections having a higher peak-to-base ratio while roller sections having shorter radial peak length H form pad sections having a lower peak-to-base ratio.

Thus, it will be readily appreciated that any number of variations in the convoluter roller configuration may be utilized to form a infinite variety of pads having varying surface configurations and varying peak-to-base ratios. This is accomplished simply by varying the radial length of the peaks H, and by varying the amount of space 58 between adjacent peaks on any one ring 56. Furthermore, while it is considered preferable for manufacturing purposes to ensure that the spacing and radial length H of the peaks in any single ring 56, remains uniform, it is within the scope of the present invention to vary the peak spacing or radial peak length within a single ring 56.

Although specific embodiments of the present invention have been selected for illustration in the drawings, it will be appreciated that a wide variety of equivalence may be substituted for those elements shown. Accordingly, the description should not be used to limit the scope of the invention, which is defined in the appended claims.

We claim:

1. A rectangular foam pad of a size sufficient for supporting a human body on a bed, said pad being elongated between two pad ends and having a planar undersurface and a convoluted upper surface, said upper surface comprising:

a first, head supporting section adjacent one said pad end and a second, foot and leg supporting section adjacent the opposite of said pad ends, each of said sections having a convoluted supporting surface comprising adjacent rows of peaks, said peaks in each row being separated by depressions, said peaks in adjacent rows being staggered to form a checkerboard pattern; and a third, torso supporting section intermediate said first and second supporting sections, said torso supporting section having a ribbed convoluted supporting surface comprising substantially parallel ribs separated by substantially parallel valleys extending longitudinally on said pad between said first and second supporting sections;

the height of said peaks in each of said first and second sections being at least as great as the height of said ribs;

each of said three sections extending the full width of said pad, neither of said first and second sections being greater than one half the length of said pad, said convoluted surface in all three sections being characterized by a peak-to-base ratio in the range of about 1.1 to about 7.0 and said foam having a density in the range of about 1 to about 5 lbs/ft3.

* * * * *